US010392084B2

(12) United States Patent
Wood

(10) Patent No.: US 10,392,084 B2
(45) Date of Patent: Aug. 27, 2019

(54) INFLATABLE SWIM PLATFORM FOR WATER SPORTS

(71) Applicant: Scott Wood, Ft. Lauderdale, FL (US)

(72) Inventor: Scott Wood, Ft. Lauderdale, FL (US)

( * ) Notice: Subject to any disclaimer, the term of this patent is extended or adjusted under 35 U.S.C. 154(b) by 0 days.

(21) Appl. No.: 16/017,268

(22) Filed: Jun. 25, 2018

(65) Prior Publication Data

US 2018/0354589 A1 Dec. 13, 2018

Related U.S. Application Data

(63) Continuation-in-part of application No. 15/883,825, filed on Jan. 30, 2018, now abandoned.

(60) Provisional application No. 62/499,739, filed on Feb. 6, 2017.

(51) Int. Cl.

| | |
|---|---|
| ***B63B 17/00*** | (2006.01) |
| ***B63B 27/14*** | (2006.01) |
| *B63B 35/85* | (2006.01) |
| *B63B 29/02* | (2006.01) |

(52) U.S. Cl.

CPC ..... *B63B 27/143* (2013.01); *B63B 2027/145* (2013.01); *B63B 2029/022* (2013.01); *B63B 2035/855* (2013.01)

(58) Field of Classification Search

CPC ..... B63B 7/08; B63B 2007/08; B63B 21/56; B63B 2021/56; B63B 27/14; B63B 27/143; B63B 2027/14; B63B 2027/145; B63B 35/34; B63B 35/36; B63B 2035/855

USPC ..... 114/242, 249, 264, 266, 267, 345, 362, 114/364; 441/35, 40

See application file for complete search history.

(56) References Cited

U.S. PATENT DOCUMENTS

| | | | | |
|---|---|---|---|---|
| 4,669,414 | A | 6/1987 | Molino | |
| 5,085,164 | A | 2/1992 | Whitton | |
| 5,133,275 | A * | 7/1992 | Maurizio | B63B 23/32 114/259 |
| 5,937,783 | A * | 8/1999 | Costa | B63B 23/30 114/259 |
| 6,805,066 | B2 | 10/2004 | Johnson | |
| 7,000,558 | B2 | 2/2006 | Johnson | |
| 7,475,652 | B2 | 1/2009 | Dvorak | |
| 7,837,526 | B1 * | 11/2010 | Doffay | B63B 35/36 114/345 |
| 7,866,275 | B2 | 1/2011 | Schmidt, Jr. | |
| 8,286,574 | B2 | 10/2012 | Müller | |
| 8,375,880 | B1 | 2/2013 | St. Clair et al. | |
| 8,479,677 | B2 | 7/2013 | Bolline et al. | |
| 8,813,672 | B2 | 8/2014 | Nelson | |

(Continued)

FOREIGN PATENT DOCUMENTS

DE 19932489 A1 2/2001

*Primary Examiner* — Daniel V Venne

(74) *Attorney, Agent, or Firm* — Christopher M. Ramsey; GrayRobinson, P.A.

(57) ABSTRACT

A swim platform for attachment to a boat includes a rearwardly tapered inflatable body including a top surface capable of supporting a standing person, an outer perimeter including a forward wall, an aft wall, and a port sidewall and a starboard sidewall extending between the forward wall and aft wall. The forward wall is positionable adjacent the transom. The forward wall is longer than the aft wall and is configured not to extend laterally beyond the starboard and port sides at the transom. The swim platform may be left in the water while the boat is moving and is designed not to interfere with the boat's wake.

8 Claims, 10 Drawing Sheets

(56) References Cited

U.S. PATENT DOCUMENTS

| | | | |
|---|---|---|---|
| 9,016,228 | B2 | 4/2015 | Dorton et al. |
| 9,278,731 | B1 | 3/2016 | Canela |
| 2001/0027740 | A1 | 10/2001 | Arias |
| 2006/0003646 | A1 | 1/2006 | Hendrickson |
| 2009/0260560 | A1 | 10/2009 | Plante et al. |
| 2011/0023770 | A1 | 2/2011 | Brown |
| 2014/0004761 | A1 | 1/2014 | Neprud |
| 2015/0197314 | A1 | 7/2015 | Gasper et al. |

* cited by examiner

INFLATABLE SWIM PLATFORM FOR WATER SPORTS

CROSS-REFERENCE TO RELATED APPLICATIONS

This is a continuation-in-part of application Ser. No. 15/883,825, filed Jan. 30, 2018 which claims the benefit of priority to provisional Application No. 62/499,739, filed Feb. 6, 2017. Both of these prior applications are incorporated by reference herein in their entireties.

FIELD

This relates to the field of boats and, more particularly, to boat swim platforms.

BACKGROUND

Many conventional watersports boats, particularly those with sterndrives, have integrated swim platforms that extend higher above the water than those on comparable inboard-powered tow sports boats. They have this arrangement to keep the swim platform above the propeller. Unfortunately, this makes it more difficult to enter the water and re-board the boat from the water, which often requires the use of a ladder. Further such swim platforms often fail to extend far enough behind the boat to provide a safe enough distance from the propeller to perform wake sports close the stern of the boat. Conventional swim platforms also often have the drawback of affecting the size and shape of the boats wake.

BRIEF SUMMARY

In view of the foregoing, it would be advantageous to have a swim platform that is inflatable, attachable to a boat, and is designed to be able to be towed behind a boat while the boat is moving, but without substantially interfering with the wake created by the boat.

Such a swim platform includes a rearwardly tapered inflatable body including a top surface capable of supporting a standing person, an outer perimeter including a forward wall, an aft wall, and a port sidewall and a starboard sidewall extending between the forward wall and aft wall. The forward wall is positionable adjacent the transom of a boat. The forward wall is longer than the aft wall and is configured not to extend laterally beyond the starboard and port sides at the transom. The swim platform may be attached to a boat having a planing hull with starboard and port sides extending aft to a stern having a transom extending laterally between the starboard and port sides.

A boat including the swim platform has a planing hull having starboard and port sides extending aft to a stern having a transom extending laterally between the starboard and port sides and an inflatable floating swim platform behind the transom and attached to the stern. The swim platform includes a rearwardly tapered inflatable body defined by an outer perimeter including a forward wall adjacent the transom, an aft wall, and a port sidewall and a starboard sidewall extending between the forward wall and aft wall. The forward wall is longer than the aft wall and does not extend laterally beyond the starboard and port sides at the transom.

A related method includes driving a boat forward through water creating a wake behind the boat. The boat has a planing hull having starboard and port sides extending aft to a stern having a transom extending laterally between the starboard and port sides. The method also involves towing, while driving the boat, an inflatable floating swim platform attached to the stern behind the transom. The swim platform includes a rearwardly tapered inflatable body defined by an outer perimeter including a forward wall adjacent the transom, an aft wall, and a port sidewall and a starboard sidewall extending between the forward wall and aft wall. The forward wall is longer than the aft wall and does not extend laterally beyond the starboard and port sides at the transom.

The following optional features may be included with the swim platform, boat, and/or the method.

The port and starboard sidewalls may each extend from the forward wall to the aft wall inwardly toward a centerline of the inflatable body at an angle of 60 degrees to 80 degrees measured between the respective port or starboard sidewall and a straight line projected between lateral forward corners of the forward wall where the forward wall meets the respective port or starboard sidewall.

A length of the forward wall may be at least 6 inches less than a transom beam of the boat.

The inflatable body may be attachable to the stern with an attachment mechanism that is affixed at an upper corner of the forward wall.

The inflatable body may be attachable to the stern with an attachment mechanism that pivots allowing the inflatable body to be raised out of water without detaching the swim platform from the stern.

The perimeter of the inflatable body may be sized so as not to intersect a wake produced by the boat.

At least one handle may be affixed to the aft wall.

A watersports performer may be propelled behind the inflatable floating swim platform while boat is being driven.

The watersports performer may be performing at least one of wake surfing, wake boarding, water skiing, or knee boarding.

DETAILED DESCRIPTION OF EXAMPLE EMBODIMENTS

Figure 1:
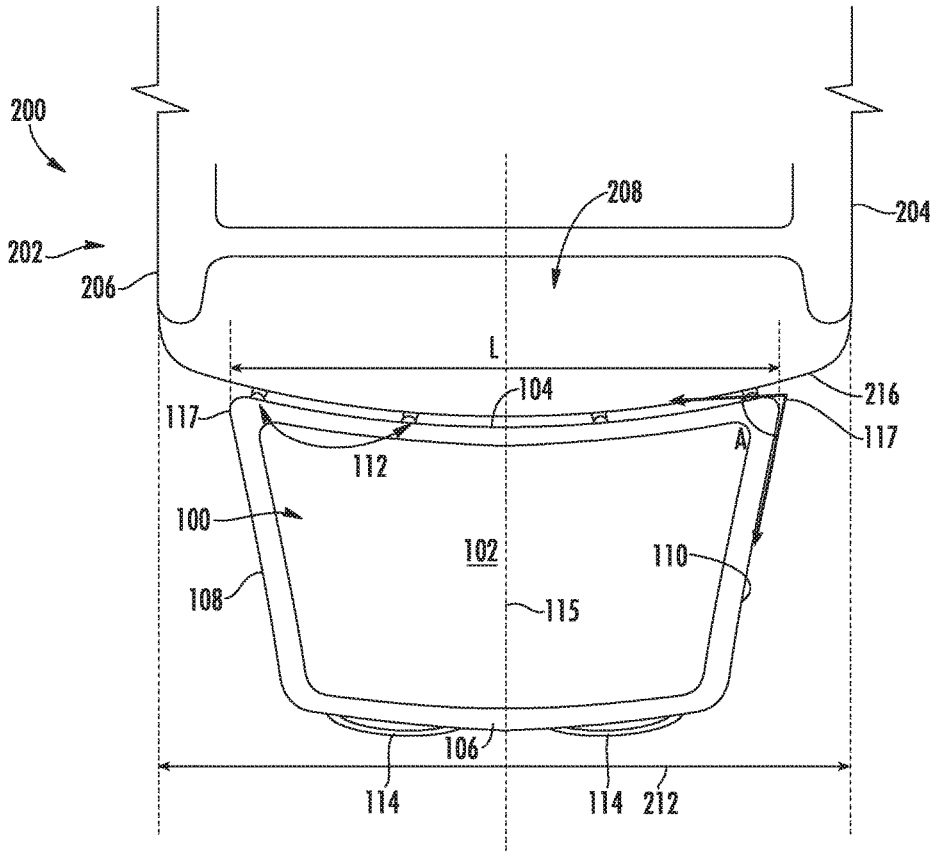
FIG. 1 is a top view of a boat with a sterndrive inboard/outboard motor with an example of the inflatable swim platform attached.

The swim platform is advantageously designed to be inflatable and attachable to a boat so that it floats beside a section of the boat. The swim platform provides a stable area where boat passengers can sit, stand, or swim while the boat is stationary in the water. When not in use, the swim platform may easily be raised from the water and re-deployed when needed. The swim platform is advantageous over other swim platforms because it can also remain in the water while the boat is moving forward without substantially interfering with the boat's wake.

The swim platform is described herein in the context of use with a planing hull watersports boat such as one used for skiing, wake surfing, wake boarding, knee boarding, or any other type of water sport where a watersports performer is propelled behind a boat.

A first example of the inflatable swim platform 100 will now be described by referring generally to FIGS. 1-6. In these drawings, the boat 200 includes a hull 202 having a starboard side 204 and a port side 206 that both extend aft to a stern 208. At the stern 208 is a transom 210 extending laterally between the starboard side 204 and port side 206. The boat 200 also includes a transom beam 212, which is the width of the boat from the starboard side 204 to the port side 206 at the transom.

Figure 2:
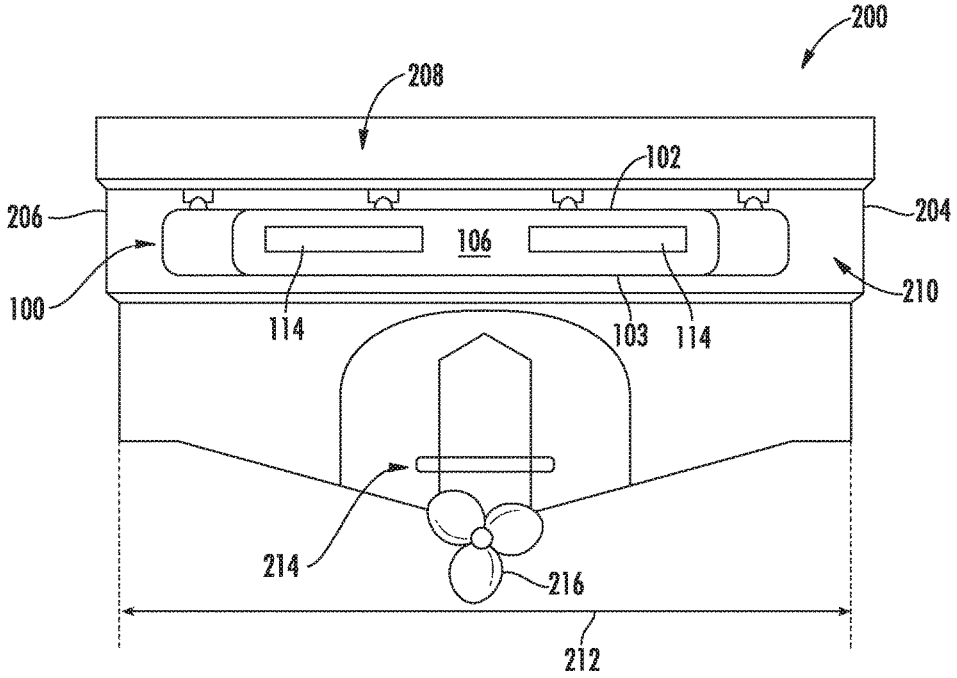
FIG. 2 is an aft view the boat of FIG. 1 with an example of the inflatable swim platform attached.
Figure 3:
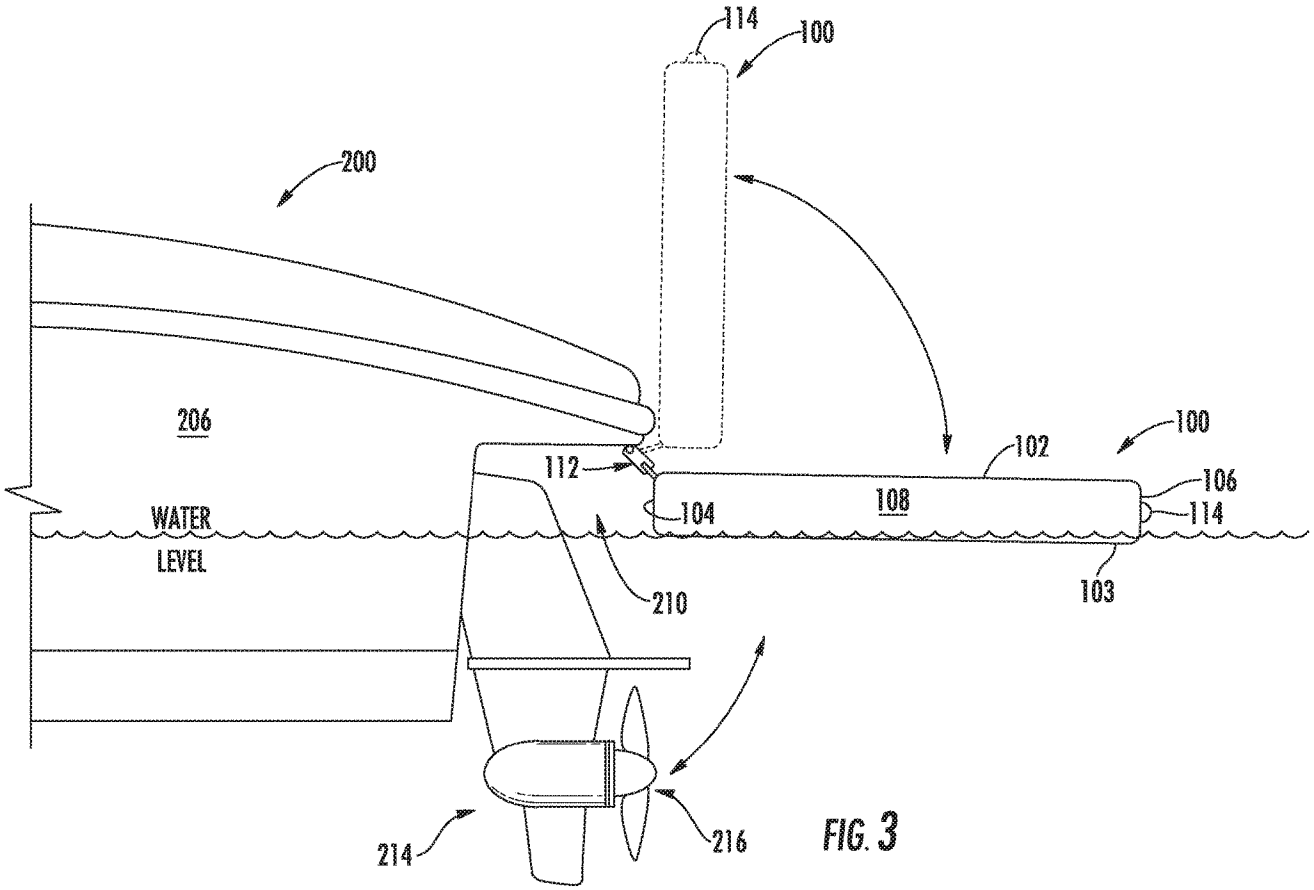
FIG. 3 is a side view the boat of FIG. 1 with an example of the inflatable swim platform attached and illustrating how the swim platform can be raised out of the water.
Figure 4:
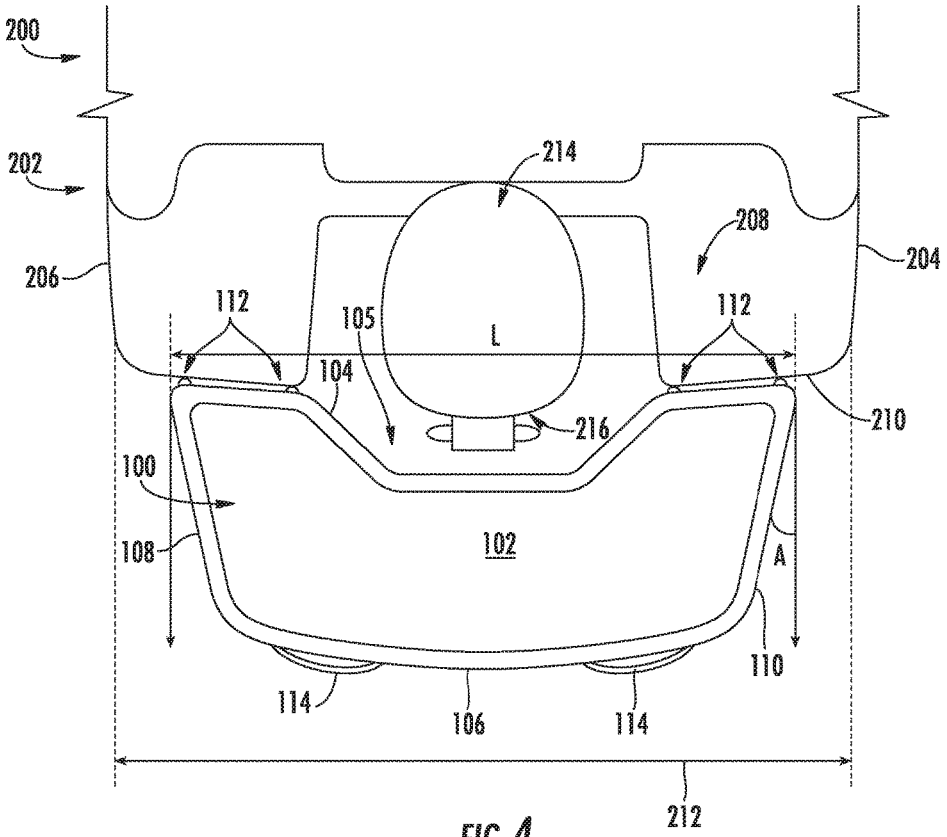
FIG. 4 is a top view of a boat with an outboard motor with an example of the inflatable swim platform attached.
Figure 5:
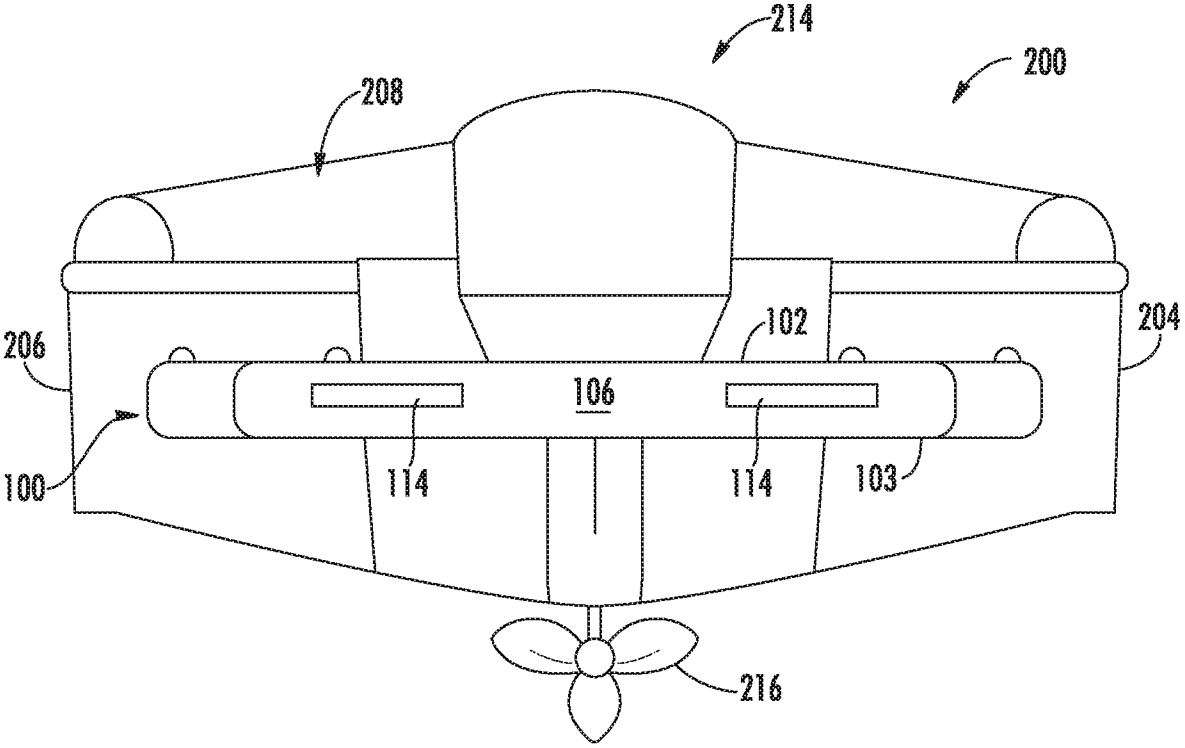
FIG. 5 is an aft view the boat of FIG. 4 with an example of the inflatable swim platform attached.
Figure 6:
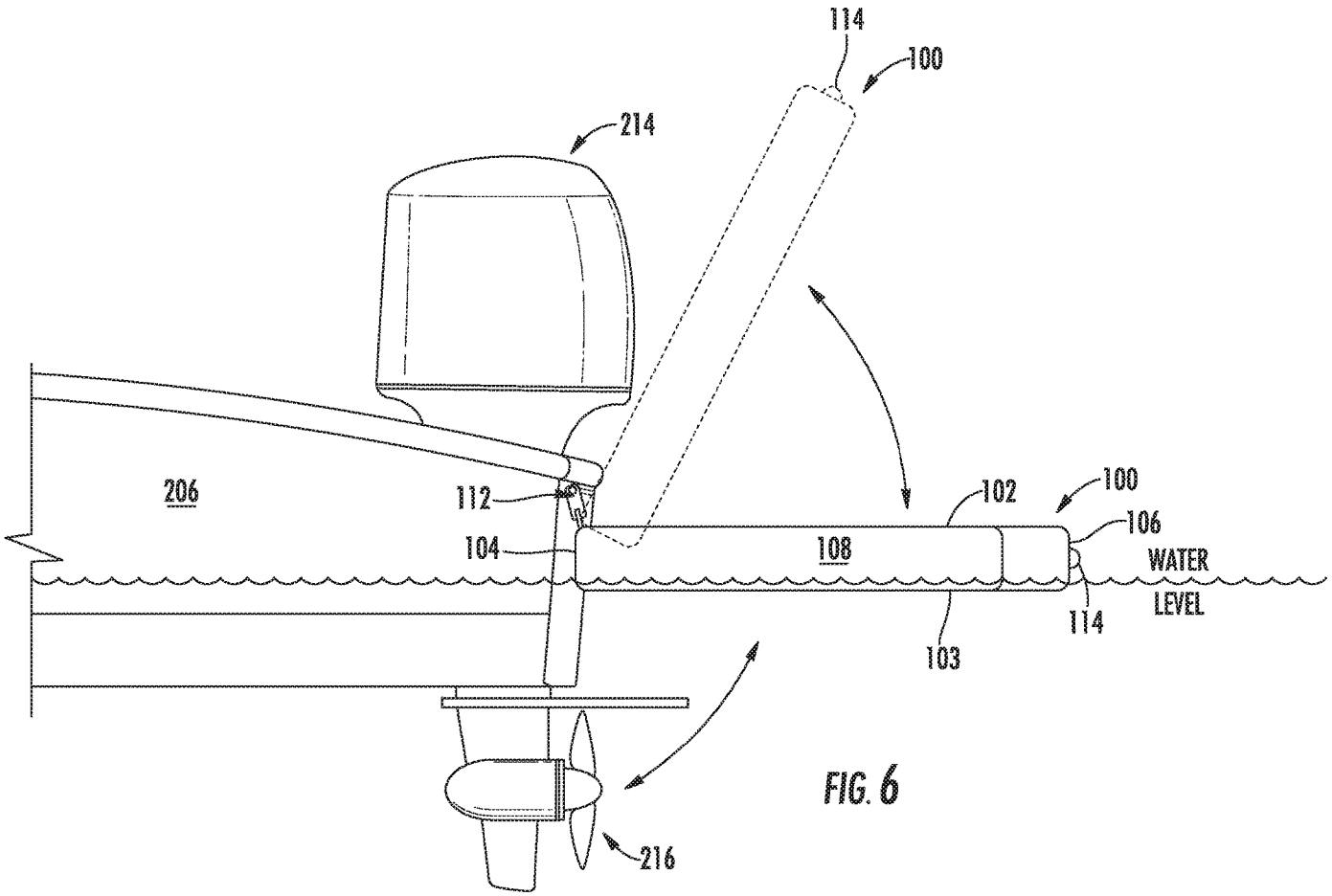
FIG. 6 is a side view the boat of FIG. 4 with an example of the inflatable swim platform attached and illustrating how the swim platform can be raised out of the water.

The boat 200 further includes a motor 214. The motor in the example of FIGS. 1-3 is a sterndrive, also known as an inboard/outboard or "I/O" drive. The motor in the example of FIGS. 4-6 is an outboard motor. The motor includes a propeller 216. The motor 214 is operable to cause the boat to move forward and reverse through the water.

The swim platform 100 has a rearwardly tapered inflatable body including a top surface capable of supporting a standing person, an outer perimeter including a forward wall 104, an aft wall 106, and a port sidewall 108 and a starboard sidewall 110 extending between the forward wall 104 and aft wall 106.

The forward wall 104 is positionable adjacent the transom 210 so that boat passengers can step off the boat 200 and onto the top surface 102, which may include a slip-resistant surface affixed to the inflatable body. The slip-resistant surface may be any type of conventional material that provides friction against a human body part to prevent slipping, especially when wet. Examples of materials for slip-resistant surfaces may include, but are not limited to, slip-resistant polymers, foams, and fabrics.

The forward wall 104 in the example of FIGS. 1-3 is different than that of the example of FIGS. 4-6 to accommodate the outboard motor 214. Accordingly, the forward wall 104 in the example of FIGS. 4-6 includes a centrally located recessed section 105.

The swim platform 100 is rearwardly tapered from the forward wall 104 to the aft wall 106 for reasons that will be explained later. The forward wall 104 is longer than the aft wall 106. The port sidewall 108 and starboard sidewall 110 each extend rearwardly from the forward wall 104 to the aft wall 106 at an angle A of 60 degrees to 80 degrees inwardly toward the centerline 115 of the swim platform moving the from forward wall 104 to the aft wall 106. The angle is measure between the respective port 108 or starboard 110 sidewall and a straight line projected between lateral forward corners 117 of the forward wall 104 where the forward wall meets the respective port 108 or starboard 110 sidewall.

The forward wall is configured not to extend laterally beyond the starboard 204 and port 206 sides at the transom 210. The length L of the forward wall 104 may, for example, be at least 6 inches or at least 10 inches less than the transom beam 212. This arrangement allows water flowing off the starboard side 204 and the port side 206 to detach from the hull and contribute to the wake without being interrupted by the swim platform 100.

The swim platform 100 is attachable to the stern 208 and, in many cases, the transom 210 with an attachment mechanism 112 that is affixed at an upper corner of the forward wall 104. As illustrated in FIG. 3, the attachment mechanism 112 pivots allowing the swim platform to be raised out of water without detaching the swim platform 100 from the stern 208. This pivoting attachment mechanism 112 also allows the swim platform 100 to float up and down over waves, to float on top of reverse wash when the boat 200 stops, and to pivot as necessary when the motor 214 is trimmed up and down.

The swim platform 100 may include least one handle 114 affixed to the inflatable body. In the examples shown, there are two handles affixed in a parallel arrangement along the aft wall 106. The handles 114 provide boat passengers a place to grab the swim platform for transport, raising and lowering it from/into the water, and for holding while swimming. In other examples, handles 114 may be positioned at other locations on the inflatable body.

It should be understood that there a many possible attachment mechanism 112 that may be used. Two possible examples are now described in additional detail.

Figure 7:
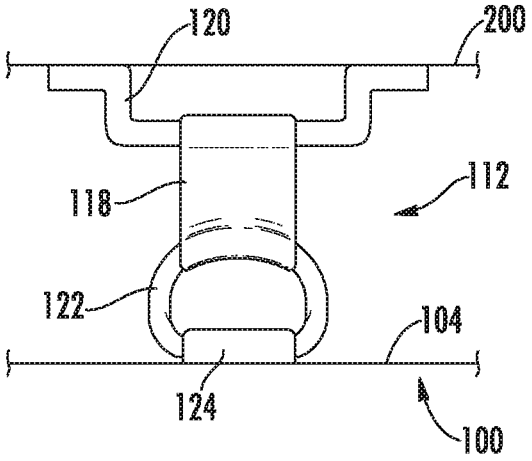
FIG. 7 is a detailed view of an example of the attachment mechanism.

Referring to FIG. 7, a first example of the attachment mechanism 112 includes a strap 118 attached on one end to a strap bracket 120 affixed to the boat 200 and on the other end to a D-ring 122 attached to the swim platform's forward wall 104 with a D-ring bracket 124.

Figure 8:
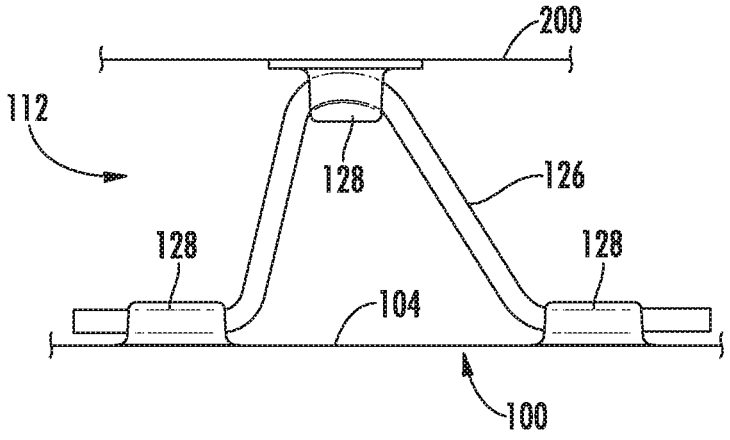
FIG. 8 is a detailed view of another example of the attachment mechanism.

Referring to FIG. 8, a second example of the attachment mechanism 112 includes a cord 126 attached on one end to a cord bracket 128 affixed to the boat 200 and on the other end to a plurality of cord brackets 128 attached to the swim platform's forward wall 104.

Additional attachment mechanisms may be positioned at different positions around the swim platform 100. In some examples, an attachment mechanism is included at the aft wall 106 for securing the swim platform 100 when it is raised out of the water.

Figure 9:
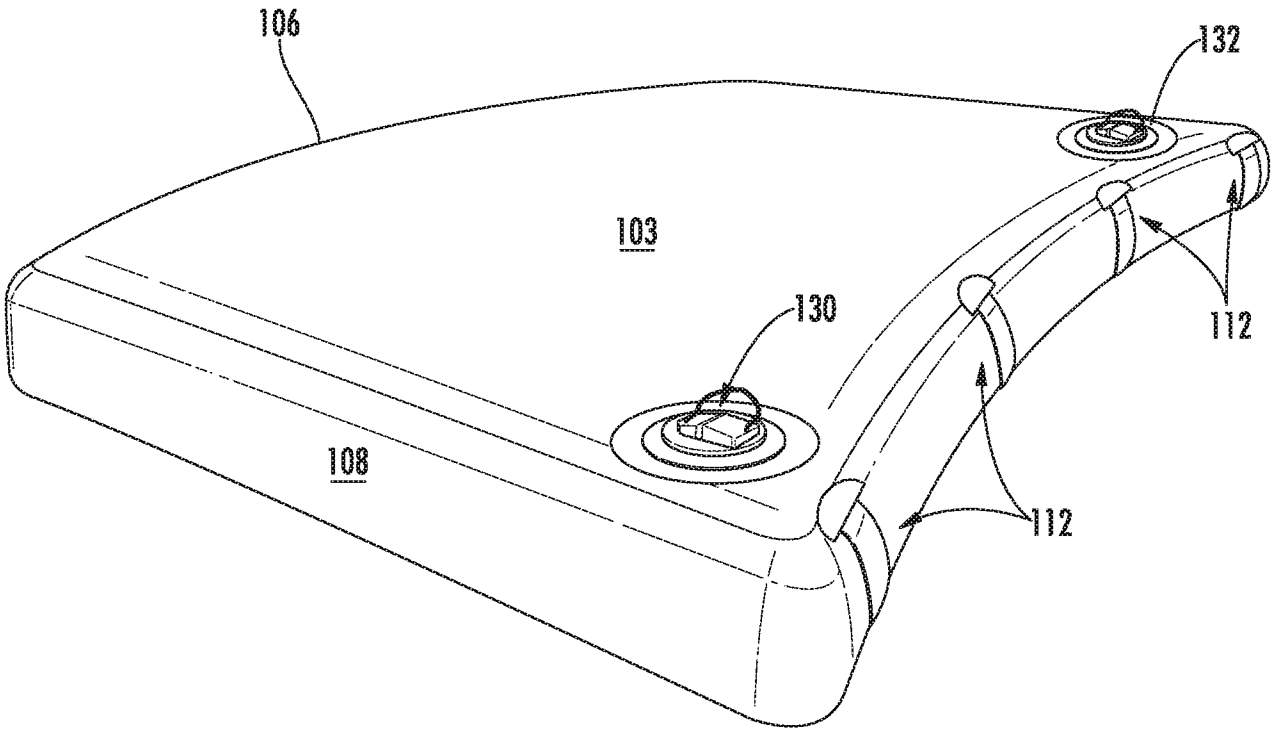
FIG. 9 is a bottom perspective view of another example of the inflatable swim platform.

Another example of the swim platform 100 is now described with reference to FIGS. 9-11. To avoid being redundant the reference numerals used above correspond to the same features in this example.

Notably, the bottom surface 103 includes a fill valve 130 and an overpressure valve 132. The fill valve 130 is operable for attachment to a pump that fills the inflatable body with air, and in turn, to release air when deflating the inflatable body. The overpressure valve 132 is operable to prevent the pressure in the inflatable body from exceeding a desired setpoint pressure. This would help prevent the inflatable body from bursting due to increased pressure, which can be caused by heat or supporting human body weight for example.

Figure 10:
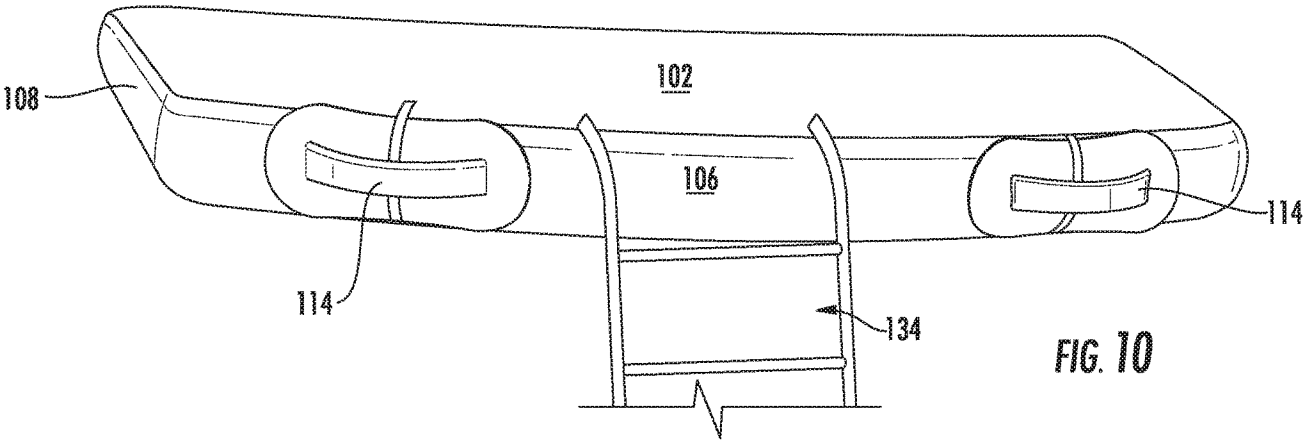
FIG. 10 is an aft perspective view of the inflatable swim platform of FIG. 9.

A ladder 134 may be attached to swim platform as shown in FIG. 10 if desired.

Figure 11:
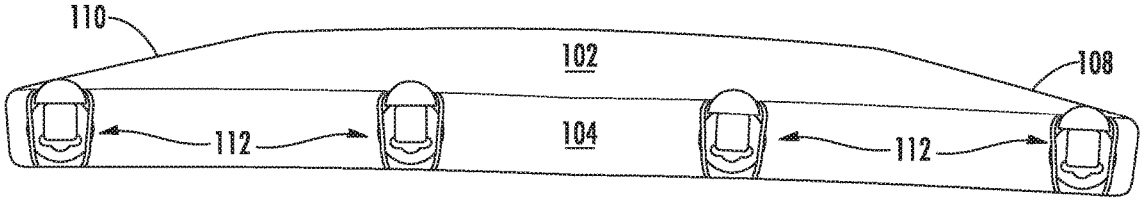
FIG. 11 is a top forward perspective view of the inflatable swim platform of FIG. 9.

FIG. 11 is a view of the forward wall 104, depicting possible locations for the attachment mechanism 112. In this case, the attachment mechanism corresponds to that of FIG. 7. The attachment mechanism is attached to the upper corner of the forward wall 104.

The inflatable body may be constructed of an inflatable marine application acceptable material such as polymer used to make inflatable watercraft. Examples of such polymers include, but are not limited to, polyvinyl chloride (PVC), chlorosulfonated polyethylene such as HYPALON®, or synthetic rubber. The interior of the inflatable body may include drop stitching to improve the integrity of the swim platform and allow it to be inflated to high enough pressures to make it rigid enough for a person to stand on while it is floating.

The overall dimensions of the swim platform 100 may vary depending on the size of the boat 200, the shape of the wake made by the boat 200, and the desired appearance. The length of the platform 100 from the forward wall 104 to the aft wall 106 along the centerline 115 of the platform 100 may be, for example 2 feet to 5 feet. Likewise the width of the platform 100 from the starboard sidewall 110 to the port sidewall may be, for example, 4 feet to 9 feet. The width will typically depend on the size of the boat and its transom beam 212. When inflated, the inflatable body may be, for example, 2 inches to 6 inches thick in certain examples.

Figure 12:
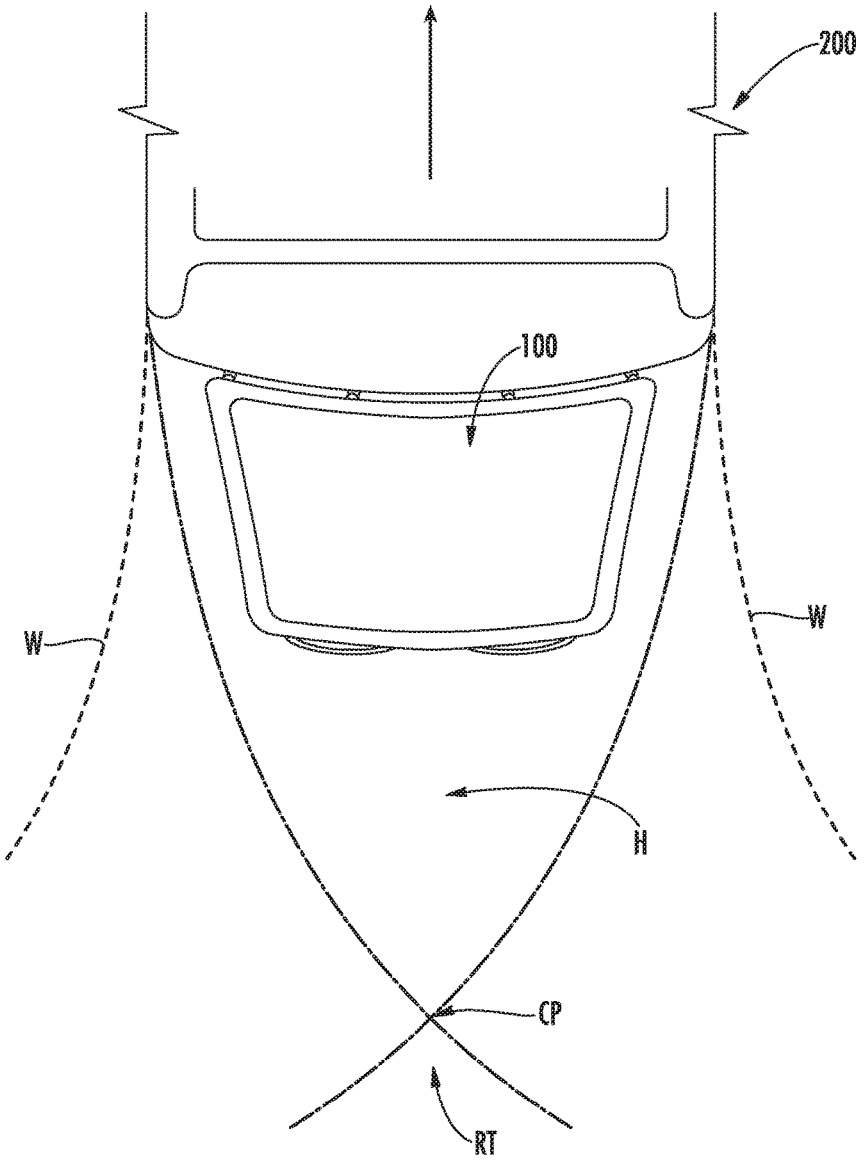
FIG. 12 is a top view of the boat of FIG. 1 as it moves forward and creates a wake behind the boat.

An exemplary use of the swim platform will now be described with reference to FIG. 12. The arrow in FIG. 12 indicates that the boat 200 is travelling forward through water and generating a wake W, indicated by the dashed lines, behind the boat. Here, the wake W is illustrated as the crest of wake, or the wake line, generated by water leaving the port side 206 and starboard side 204 of the boat 200.

The boat 200 also generates a hole H in the water. The hole H is defined between a convergence point CP where the boat's prop wash converges with water that has detached from the boat's hull as the boat moves forward. Behind the convergence point is the so-called rooster tail where the water rises upwardly and often creates a spray behind the boat.

The dimensions of the swim platform 100 are selected so that the swim platform 100 does not intersect the wake W, the convergence point CP, or the rooster tail RT when the boat 200 is moving forward through the water. Accordingly, in the example shown in FIG. 12, the swim platform 100 essentially sits within the hole H as the boat 200 is driven forward. This allows the boat 200 to propel a watersports performer such as a wake surfer, wake boarder, water skier, knee boarder or the like through the water while the swim platform 100 is being pulled behind the boat 200 while still in the water.

When not in use, the swim platform 100 can be deflated and detached from the boat 200 and rolled up for storage. Using such an inflatable swim platform instead of a conventional rigid swim platform effectively reduces the overall length of the boat 200, which is helpful when the boat 200 is parked in a garage or a boat slip.

This disclosure describes certain examples, but not all possible examples of the swim platform and related methods. Where a particular feature is disclosed in the context of a particular example, that feature can also be used, to the extent possible, in combination with and/or in the context of other examples. The swim platform may, be embodied in many different forms and should not be construed as limited to only the examples described here. The scope of what is claimed is not limited only to the details described here.

That which is claimed is:

1. A method of operating a boat, the method comprising:

driving a boat forward through water creating a wake behind the boat, the boat having a planing hull having starboard and port sides extending aft to a stern having a transom extending laterally between the starboard and port sides; and towing, while driving the boat, an inflatable floating swim platform attached to the stern behind the transom, the swim platform including:

a rearwardly tapered inflatable body defined by an outer perimeter including a forward wall adjacent the transom, an aft wall, and a port sidewall and a starboard sidewall extending between the forward wall and aft wall;

wherein the forward wall is longer than the aft wall and the forward wall does not extend laterally beyond the starboard and port sides at the transom.

2. The method of claim 1, further comprising propelling a watersports performer behind the inflatable floating swim platform while driving the boat.

3. The method of claim 2, wherein the watersports performer is performing at least one of wake surfing, wake boarding, water skiing, or knee boarding.

4. The method of claim 1, wherein the wake propagates outwardly from the port and starboard sides of the boat and the swim platform does not intersect the wake.

5. The method of claim 1, wherein the port and starboard sidewalls each extend from the forward wall to the aft wall inwardly toward a centerline of the inflatable body at an angle of 60 degrees to 80 degrees measured between the respective port or starboard sidewall and a straight line projected between lateral forward corners of the forward wall where the forward wall meets the respective port or starboard sidewall.

6. The method of claim 1, wherein a length of the forward wall is at least 6 inches less than a transom beam of the boat.

7. The method of claim 1, wherein the inflatable floating swim platform is attached to the stern with an attachment mechanism that is affixed at an upper corner of the forward wall.

8. The method of claim 1, wherein the inflatable floating swim platform is attached to the stern with an attachment mechanism that pivots allowing the swim platform to be raised out of water without detaching the swim platform from the stern.

* * * * *